US012276439B2

(12) United States Patent
Konowalczyk

(10) Patent No.: US 12,276,439 B2
(45) Date of Patent: Apr. 15, 2025

(54) METHODS AND SYSTEMS FOR MODULATING ENERGY USAGE

(71) Applicant: OCTOPUS ENERGY HEATING LIMITED, London (GB)

(72) Inventor: Peter Konowalczyk, London (GB)

(73) Assignee: OCTOPUS ENERGY HEATING LIMITED, London (GB)

( * ) Notice: Subject to any disclaimer, the term of this patent is extended or adjusted under 35 U.S.C. 154(b) by 0 days.

(21) Appl. No.: 18/276,007

(22) PCT Filed: Feb. 7, 2022

(86) PCT No.: PCT/IB2022/051067

§ 371 (c)(1),
(2) Date: Aug. 4, 2023

(87) PCT Pub. No.: WO2022/168036

PCT Pub. Date: Aug. 11, 2022

(65) Prior Publication Data

US 2024/0093908 A1 Mar. 21, 2024

(30) Foreign Application Priority Data

Feb. 7, 2021 (GB) ..... 2101678
Jul. 2, 2021 (GB) ..... 2109593
(Continued)

(51) Int. Cl.
*F24H 15/174* (2022.01)
*F24D 19/10* (2006.01)
*F24H 15/219* (2022.01)

(52) U.S. Cl.
CPC ..... *F24H 15/174* (2022.01); *F24D 19/1054* (2013.01); *F24H 15/219* (2022.01); *F24D 2200/12* (2013.01)

(58) Field of Classification Search
CPC ..... E03C 1/057; H03K 17/962; H03K 2217/960755
See application file for complete search history.

(56) References Cited

U.S. PATENT DOCUMENTS 4,798,059 A 1/1989 Morita
2011/0081255 A1* 4/2011 Steger ..... F04D 15/0066 417/44.1
(Continued)

FOREIGN PATENT DOCUMENTS

AT 504285 A1 4/2008
CN 201191144 Y 2/2009
(Continued)

OTHER PUBLICATIONS

Search Report of the United Kingdom Patent Office in related UK Patent Appl. No. GB2109593.0, dated Aug. 20, 2021, 1 page.
(Continued)

*Primary Examiner* — Kidest Bahta
(74) *Attorney, Agent, or Firm* — Bochner PLLC; Andrew Bochner

(57) ABSTRACT

The present disclosure provides a computer-implemented method of modulating energy consumption by a water provision system, the water provision system comprising a heat pump configured to transfer thermal energy from the surrounding to a thermal energy storage medium and a control module configured to control operation of the water provision system, the water provision system being configured to provide water heated by the thermal energy storage medium to a water outlet, the method being performed by the control module and comprising: setting a first temperature for heated water being provided to the water outlet; setting a second temperature for heated water being provided to the water outlet, the second temperature being different from the first temperature; and upon determining
(Continued)

that the water outlet is turned on, alternating a temperature of heated water provided to the water outlet between the first temperature and the second temperature.

20 Claims, 3 Drawing Sheets

(30) Foreign Application Priority Data

| | | |
|---|---|---|
| Jul. 2, 2021 | (GB) | 2109594 |
| Jul. 2, 2021 | (GB) | 2109596 |
| Jul. 2, 2021 | (GB) | 2109597 |
| Jul. 2, 2021 | (GB) | 2109598 |
| Jul. 2, 2021 | (GB) | 2109599 |
| Jul. 2, 2021 | (GB) | 2109600 |
| Aug. 2, 2021 | (GB) | 2111075 |

(56) References Cited

U.S. PATENT DOCUMENTS

| | | | | |
|---|---|---|---|---|
| 2011/0186135 | A1* | 8/2011 | Hanna | E03C 1/05 137/1 |
| 2011/0271953 | A1 | 11/2011 | Wortmann et al. | |
| 2012/0072040 | A1* | 3/2012 | Kaji | H02J 3/32 700/291 |
| 2012/0152514 | A1* | 6/2012 | Takasaki | F24H 15/238 165/10 |
| 2012/0205456 | A1* | 8/2012 | Honma | F24D 19/106 237/2 B |
| 2013/0051777 | A1* | 2/2013 | Brian | F24H 15/156 219/490 |
| 2018/0038616 | A1 | 2/2018 | Scheers et al. | |
| 2021/0318027 | A1 | 10/2021 | Boros et al. | |

FOREIGN PATENT DOCUMENTS

| | | | | |
|---|---|---|---|---|
| CN | 201265954 | Y | 7/2009 | |
| CN | 203758014 | U | 8/2014 | |
| CN | 104714574 | A | 6/2015 | |
| CN | 109210804 | A | 1/2019 | |
| CN | 111189348 | A | 5/2020 | |
| CN | 111197864 | A | 5/2020 | |
| CN | 111536696 | A | 8/2020 | |
| CN | 111536697 | A * | 8/2020 | |
| CN | 111750528 | A | 10/2020 | |
| CN | 111811142 | A | 10/2020 | |
| DE | 29921889 | U1 | 6/2000 | |
| DE | 10006564 | A1 | 8/2000 | |
| DE | 10151253 | C1 | 11/2002 | |
| DE | 102008043030 | A1 | 4/2010 | |
| DE | 102014225693 | A1 | 6/2016 | |
| EP | 0007538 | A1 | 2/1980 | |
| EP | 1684035 | A2 | 7/2006 | |
| EP | 2799784 | A2 * | 11/2014 | F24D 19/1072 |
| JP | S5795534 | A | 6/1982 | |
| JP | S5812992 | A | 1/1983 | |
| JP | H01256792 | A | 10/1989 | |
| JP | H08190392 | A | 7/1996 | |
| JP | 2009229007 | A | 10/2009 | |
| JP | 2011089692 | A | 5/2011 | |
| JP | 2012002469 | A | 1/2012 | |
| KR | 20100030141 | A | 3/2010 | |
| WO | 2020209979 | A2 | 10/2020 | |

OTHER PUBLICATIONS

Search Report of the United Kingdom Patent Office in related UK Patent Appl. No. GB2109594.8, dated Aug. 12, 2021, 1 page.
Search Report of the United Kingdom Patent Office in related UK Patent Appl. No. GB2109596.3, dated Aug. 10, 2021, 1 page.
Search Report of the United Kingdom Patent Office in related UK Patent Appl. No. GB2109597.1, dated Aug. 10, 2021, 1 page.
Search Report of the United Kingdom Patent Office in related UK Patent Appl. No. GB2109598.9, dated Aug. 10, 2021, 1 page.
Examination Report of the United Kingdom Patent Office in related UK Patent Appl. No. GB2109599.7, dated Feb. 14, 2023, 2 pages.
Search Report of the United Kingdom Patent Office in related UK Patent Appl. No. GB2109599.7, dated Aug. 10, 2021, 1 page.
Search Report of the United Kingdom Patent Office in related UK Patent Appl. No. GB2109600.3, dated Aug. 20, 2021, 1 page.
Search Report of the United Kingdom Patent Office in related UK Patent Appl. No. GB2215387.8, dated Jan. 16, 2023, 1 page.
Search Report of the United Kingdom Patent Office in related UK Patent Appl. No. GB2300970.7, dated Feb. 20, 2023, 2 pages.
Search Report of the United Kingdom Patent Office in related UK Patent Appl. No. GB2304349.0, dated Apr. 25, 2023, 1 page.
Search Report of the United Kingdom Patent Office in related UK Patent Appl. No. GB2111075.4, dated Aug. 27, 2021, 1 page.
Search Report of the United Kingdom Patent Office in related UK Patent Appl. No. GB2201565.5, dated Mar. 22, 2022, 1 page.
International Search Report and Written Opinion of the International Searching Authority in relation to International Application No. PCT/IB2022/051067, dated Jun. 7, 2022, 9 pages.
First Office Action of the China National Intellectual Property Administration (CNIPA) in related Chinese Appl. No. 202280023836.6, dated May 17, 2024, 18 pages.

* cited by examiner

METHODS AND SYSTEMS FOR MODULATING ENERGY USAGE

The present disclosure relates to methods and systems for managing utility consumption. In particular the present disclosure relates to methods and systems for actively modulating energy consumption in a domestic setting, as well as commercial, public and other settings with water and/or energy provisions.

BACKGROUND

Whether it is in a commercial or domestic setting, heated water is required throughout the day all year round. It goes without saying that the provision of heated water requires both clean water and a source of heat. To provide heated water, a heating system is provided to an often centralised water provision system to heat water up to a predetermined temperature e.g. set by a user, and the heat source used is conventionally one or more electric heating elements or burning of natural gas. Generally, during periods of high energy (e.g. gas or electricity) demand utilities providers would implement a peak tariff which increases the unit cost of energy, partly to cover the additional cost of having to purchase more energy to supply to customers and partly to discourage unnecessary energy usage. Then, during periods of low energy demand utilities providers would implement an off-peak tariff which lowers the unit cost of energy to incentivise customers to switch to using energy during these off-peak periods instead of peak periods to achieve an overall more balanced energy consumption over time. However, such strategies are only effective if customers are always aware of the changes in tariffs and in addition make a conscious effort to modify their energy consumption habits.

Clean water as utility is currently receiving much attention. As clean water becoming scarcer, there has been much effort to educate the public on the conservation of clean water as well as development of systems and devices that reduce water consumption, such as aerated showers and taps to reduce water flow, showers and taps equipped with motion sensors that stop the flow of water when no motion is detected, etc. However, these systems and devices are restricted to a single specific use and only have limited impact on problematic water consumption habits.

With growing concerns over the environmental impact of energy consumption, there has been a recent growing interest in the use of heat pump technologies as a way of providing domestic heated water. A heat pump is a device that transfers thermal energy from a source of heat to a thermal reservoir. Although a heat pump requires electricity to accomplish the work of transferring thermal energy from the heat source to the thermal reservoir, it is generally more efficient than electrical resistance heaters (electrical heating elements) as it typically has a coefficient of performance of at least 3 or 4. This means under equal electricity usage 3 or 4 times the amount of heat can be provided to users via heat pumps compared to electrical resistance heaters.

The heat transfer medium that carries the thermal energy is known as a refrigerant. Thermal energy from the air (e.g. outside air, or air from a hot room in the house) or a ground source (e.g. ground loop or water filled borehole) is extracted by a receiving heat exchanger and transferred to a contained refrigerant. The now higher energy refrigerant is compressed, causing it to raise temperature considerably, where this now hot refrigerant exchanges thermal energy via a heat exchanger to a heating water loop. In the context of heated water provision, heat extracted by the heat pump can be transferred to a water in an insulated tank that acts as a thermal energy storage, and the heated water may be used at a later time when needed. The heated water may be diverted to one or more water outlets, e.g. a tap, a shower, a radiator, as required. However, a heat pump generally requires more time compared to electrical resistance heaters to get water up to the desired temperature.

Since different households, workplaces and commercial spaces have different requirements and preferences for heated water usage, new ways of heated water provision are desirable in order to enable heat pumps to be a practical alternative to electrical heaters. Moreover, in order to conserve energy and water, it may be desirable to modulate the consumption of energy and clean water; however, modulating utility consumption cannot simply be a blanket cap on usage.

It is therefore desirable to provide improved methods and systems for modulating energy consumption.

SUMMARY

In view of the foregoing, an aspect of the present technology provides a computer-implemented method of modulating energy consumption by a water provision system, the water provision system comprising a heat pump configured to transfer thermal energy from the surrounding to a thermal energy storage medium and a control module configured to control operation of the water provision system, the water provision system being configured to provide water heated by the thermal energy storage medium to a water outlet, the method being performed by the control module and comprising: setting a first temperature for heated water being provided to the water outlet; setting a second temperature for heated water being provided to the water outlet, the second temperature being different from the first temperature; and upon determining that the water outlet is turned on, alternating a temperature of heated water provided to the water outlet between the first temperature and the second temperature, wherein the first temperature and/or the second temperature are determined based on an energy consumption target.

According to embodiments of the present technology, when a water outlet, e.g. a shower, is turned on, the temperature of the heated water being provided to the water outlet is alternated between a first temperature and a second temperature. By modulating the temperature of water being supplied to the water outlet between a warmer temperature and a cooler temperature, it is possible to reduce the energy consumed by heating water for provision to the water outlet compared to when the water temperature is maintained at the warmer temperature for the whole duration. The first and/or second temperature are determined based on an energy consumption target, which may be set by a human operator or according to energy efficiency consideration specific to the water provision system, such that alternating the temperature of heated water provided to the water outlet between the first temperature and the second temperature modulates energy consumption by the water provision system to a level at or below the energy consumption target. In doing so, it is possible to avoid having a user manually setting arbitrary temperatures that may not achieve a desired level of energy consumption saving. The present embodiment is of particular relevance when water is heated by a thermal energy storage, which stores heat transferred from the surrounding by a heat pump, in that by reducing the energy requirement for each use of heated water, it is possible for the same amount of energy that is stored in the thermal energy storage to last longer or to supply heated water to more water outlets. In doing so, the water provision system can reduce its reliance on other less energy efficient means of heating water such as using electrical heating elements, thus making the water provision system more energy efficient overall.

In some embodiments, the control module may comprise a timer, and the method may further comprise, upon alternating the temperature of heated water provided to the water outlet to the first temperature, initializing the timer to zero to record a first elapse time.

In some embodiments, the method may further comprise, upon determining that the first elapse time exceeds a first time threshold, alternating the temperature of heated water provided to the water outlet to the second temperature.

In some embodiments, the control module may comprise a timer, and the method may further comprise, upon alternating the temperature of heated water provided to the water outlet to the second temperature, initializing the timer to zero to record a second elapse time.

In some embodiments, the method may further comprise, upon determining that the second elapse time exceeds a second time threshold, alternating the temperature of heated water provided to the water outlet to the first temperature.

In some embodiments, the first time threshold and/or the second time threshold may be set by a user.

In some embodiments, the first time threshold and/or the second time threshold may be a multiple of a minute.

In some embodiments, the first temperature may be higher than the second temperature, and the first time threshold may be higher than the second time threshold.

In some embodiments, the method may further comprise receiving an input of the first temperature from a user.

In some embodiments, the method may further comprise receiving an input of the second temperature from a user.

The first and second temperatures may be predetermined based on factory settings of the control module, for example based on energy consumption considerations and/or health considerations.

In some embodiments, the temperature of heated water provided to the water outlet may be alternated only once from the first temperature to the second temperature during a single use of the water outlet.

In some embodiments, the temperature of heated water provided to the water outlet may be alternated a plurality of times between the first temperature and the second temperature during a single use of the water outlet.

In some embodiments, the first temperature and the second temperature may be in a range of 35° C. to 44° C.

Different users may have different preferences for water temperature. In some embodiments, the method may further comprise storing a plurality of user profiles, each profile corresponding to one of a plurality of users of the water outlet and comprises a corresponding first temperature.

In some embodiments, each profile may comprise a corresponding second temperature.

Another aspect of the present technology provides a control module for controlling operation of a water provision system, the water provision system comprising a heat pump configured to transfer thermal energy from the surrounding to a thermal energy storage medium and a control module configured to control operation of the water provision system, the water provision system being configured to provide water heated by the thermal energy storage medium to a water outlet, the control module being configured to implement the method as described above.

A further aspect of the present technology provides a water provision system for provisioning heated water to a water outlet, comprising: a thermal energy storage configured to store thermal energy; a heat exchanger arranged proximal to the thermal energy storage configured to heat water for provision by the water provision system using thermal energy stored in the thermal energy storage; a heat pump configured to transfer thermal energy from the surrounding to the thermal energy storage; and a control module configured to control operation of the water provision system, the control module being configured to: set a first temperature for heated water being provided to the water outlet; set a second temperature for heated water being provided to the water outlet, the second temperature being different from the first temperature; and upon determining that the water outlet is turned on, alternate a temperature of heated water provided to the water outlet between the first temperature and the second temperature, wherein the first temperature and the second temperature are determined based on an energy consumption target such that alternation of heated water provided to the water outlet between the first temperature and the second temperature modulates energy consumption by the water provision system to a level at or below the energy consumption target.

In some embodiments, the water provision system may further comprise one or more electrical heating elements configured to heat water for provision by the water provision system.

In some embodiments, the water outlet may be a shower.

The invention also provides a computer program stored on a non-transitory computer readable storage medium for, when executed on a computer system, instructing the computer system to carry out the computer-implemented method of modulating energy consumption by a water provision system as described above.

Implementations of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

Embodiments of the present disclosure will now be described with reference to the accompanying drawings, in which.

DETAILED DESCRIPTION

In view of the foregoing, the present disclosure provides various approaches for the provision of heated water using or assisted by a heat pump, and in some cases for modulating the use of utilities including water and energy to reduce water and energy wastage.

Water Provision System

Figure 1:
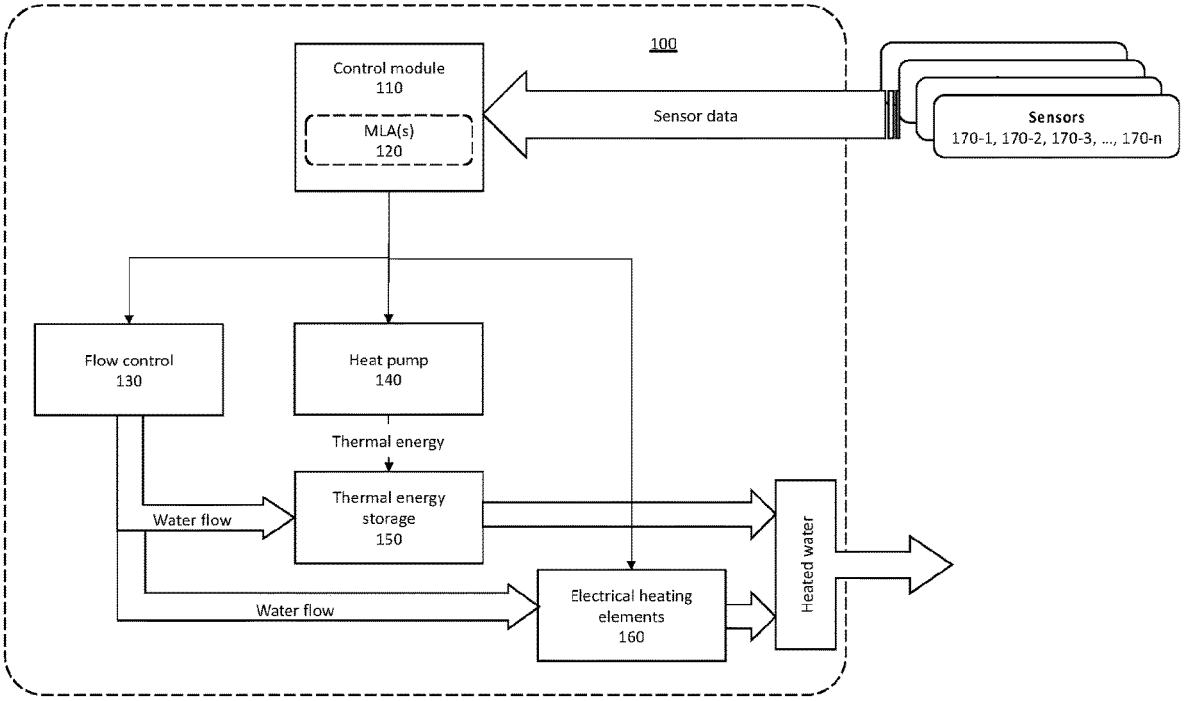
FIG. 1 is a schematic system overview of an exemplary water provision system.

In embodiments of the present techniques, cold and heated water is provisioned by a centralized water provision system to a plurality of water outlets, including taps, showers, radiators, etc., for a building in a domestic or commercial setting. An exemplary water provision system 100 is shown in FIG. 1.

In the present embodiment, the water provision system 100 comprises a control module 110. The control module 110 is communicatively coupled to, and configured to control, various elements of the water provision system, including flow control 130 for example in the form of one or more valves arranged to control the flow of water internal and external to the system, a (ground source or air source) heat pump 140 configured to extract heat from the surrounding and deposit the extracted heat in a thermal energy storage 150 to be used to heat water, and one or more electric heating elements 160 configured to directly heat cold water to a desired temperature by controlling the amount of energy supplied to the electric heating elements 160. Heated water, whether heated by the thermal energy storage 150 or heated by the electric heating elements 160, is then directed to one or more water outlets and or a central heating system as and when needed. In the embodiments, the heat pump 140 extracts heat from the surrounding into a thermal energy storage medium within the thermal energy storage 150 until the thermal energy storage medium reach an operation temperature, then cold water e.g. from the mains can be heated by the thermal energy storage medium to the desired temperature. The heated water may then be supplied to various water outlets in the system.

In the present embodiment, the control module 110 is configured to receive input from a plurality of sensors 170-1, 170-2, 170-3, . . . , **170-*n*. The plurality of sensors 170-1, 170-2, 170-3, . . . , 170-*n* may for example include one or more air temperature sensors disposed indoor and/or outdoor, one or more water temperature sensors, one or more water pressure sensors, one or more timers, one or more motion sensors, and may include other sensors not directly linked to the water provision system 100 such as a GPS signal receiver, calendar, weather forecasting app on e.g. a smartphone carried by an occupant and in communication with the control module via a communication channel. The control module 110 is configured, in the present embodiment, to use the received input to perform a variety of control functions, for example controlling the flow of water through the flow control 130 to the thermal energy storage 150 or electric heating elements 160** to heat water.

Optionally, one or more machine learning algorithm (MLA) 120 may execute on the control module 110, for example on a processor (not shown) of the control module 110 or on a server remote from the control module 110 and communicates with the processor of the control module 110 over a communication channel. For example, the MLA 120 may be trained using the input sensor data received by the control module 110 to establish a baseline water and energy usage pattern based e.g. on the time of the day, the day of the week, the date (e.g. seasonal changes, public holiday), occupancy, etc. The learned usage pattern may then be used to determine, and in some cases improve, the various control functions performed by the control module 110, and/or generate a report e.g. to enable a user to analyze their utility usage and/or provide suggestions for more efficient utility usage.

While a heat pump is generally more energy efficient for heating water compared to an electrical resistance heater, a heat pump requires time to transfer a sufficient amount of thermal energy into a thermal energy storage medium for it to reach a desired operating temperature before heat from the thermal energy storage medium can be used to heat water; thus, a heat pump generally takes longer to heat the same amount of water to the same temperature compared to an electrical resistance heater. In some embodiments, the heat pump 140 may for example use a phase change material (PCM), which changes from a solid to a liquid upon heating, as a thermal energy storage medium. In this case, additional time may be required to turn the PCM from solid to liquid, if it has been allowed to solidify, before thermal energy extracted by the heat pump can be used to raise the temperature of the thermal storage medium. Although this approach of heating water may be slower, the overall amount of energy consumed for heating water is less compared to heating water with electric heating elements, so overall, energy is conserved and the cost for heated water provision is reduced.

Phase Change Materials

In the present embodiments, a phase change material may be used as a thermal storage medium for the heat pump. One suitable class of phase change materials are paraffin waxes which have a solid-liquid phase change at temperatures of interest for domestic hot water supplies and for use in combination with heat pumps. Of particular interest are paraffin waxes that melt at temperatures in the range 40 to 60 degrees Celsius (° C.), and within this range waxes can be found that melt at different temperatures to suit specific applications. Typical latent heat capacity is between about 180 kJ/kg and 230 kJ/kg and a specific heat capacity of perhaps 2.27 $Jg^{-1}$ $K^{-1}$ in the liquid phase, and 2.1 $Jg^{-1}$ $K^{-1}$ in the solid phase. It can be seen that very considerable amounts of energy can be stored taking using the latent heat of fusion. More energy can also be stored by heating the phase change liquid above its melting point. For example, when electricity costs are relatively low during off-peak periods, the heat pump may be operated to "charge" the thermal energy storage to a higher-than-normal temperature to "overheat" the thermal energy storage.

A suitable choice of wax may be one with a melting point at around 48° C., such as n-tricosane $C_{23}$, or paraffin $C_{20}$-$C_{33}$, which requires the heat pump to operate at a temperature of around 51° C., and is capable of heating water to a satisfactory temperature of around 45° C. for general domestic hot water, sufficient for e.g. kitchen/bathroom taps, shower, etc. Cold water may be added to a flow to reduce water temperature if desired. Consideration is given to the temperature performance of the heat pump. Generally, the maximum difference between the input and output temperature of the fluid heated by the heat pump is preferably kept in the range of 5° C. to 7° C., although it can be as high as 10° C.

While paraffin waxes are a preferred material for use as the thermal energy storage medium, other suitable materials may also be used. For example, salt hydrates are also suitable for latent heat energy storage systems such as the present ones. Salt hydrates in this context are mixtures of inorganic salts and water, with the phase change involving the loss of all or much of their water. At the phase transition, the hydrate crystals are divided into anhydrous (or less aqueous) salt and water. Advantages of salt hydrates are that they have much higher thermal conductivities than paraffin waxes (between 2 to 5 times higher), and a much smaller volume change with phase transition. A suitable salt hydrate for the current application is $Na_2S_2O_3 \cdot 5H_2O$, which has a melting point around 48° C. to 49° C., and latent heat of 200-220 kJ/kg.

Energy Modulation

Numerous studies have found that the optimal water temperature for shower or bath water for skin health is no more than a few degrees above body temperature, that is between about 37° C. to 41° C. However, many people are accustomed to showering or bathing at higher water temperature. This not only impacts on skin health, but also on energy consumption, in that more energy is used for heating water than is necessary. The present technology therefore provides methods and systems to modulate the water temperature of shower and bath water, and in turn modulate energy consumption.

The present technology recognizes that, for most users, a sudden change in shower or bath water temperature, especially when accustomed to a much higher water temperature, would result in much discomfort that may result in a reduced likelihood of the users adapting to the new water temperature. The present technology therefore provides two approaches to modulate shower water temperature. In a first approach, shower water temperature is gradually reduced from a user's preferred water temperature to a selected optimal water temperature (e.g. 41° C.). This approach can be implemented to modulate bath water temperature if desired. In a second approach, shower water temperature is modulated between a higher water temperature and a lower water temperature (e.g. between 37° C. and 41° C.) during a single shower.

Gradual Temperature Reduction

Figure 2:
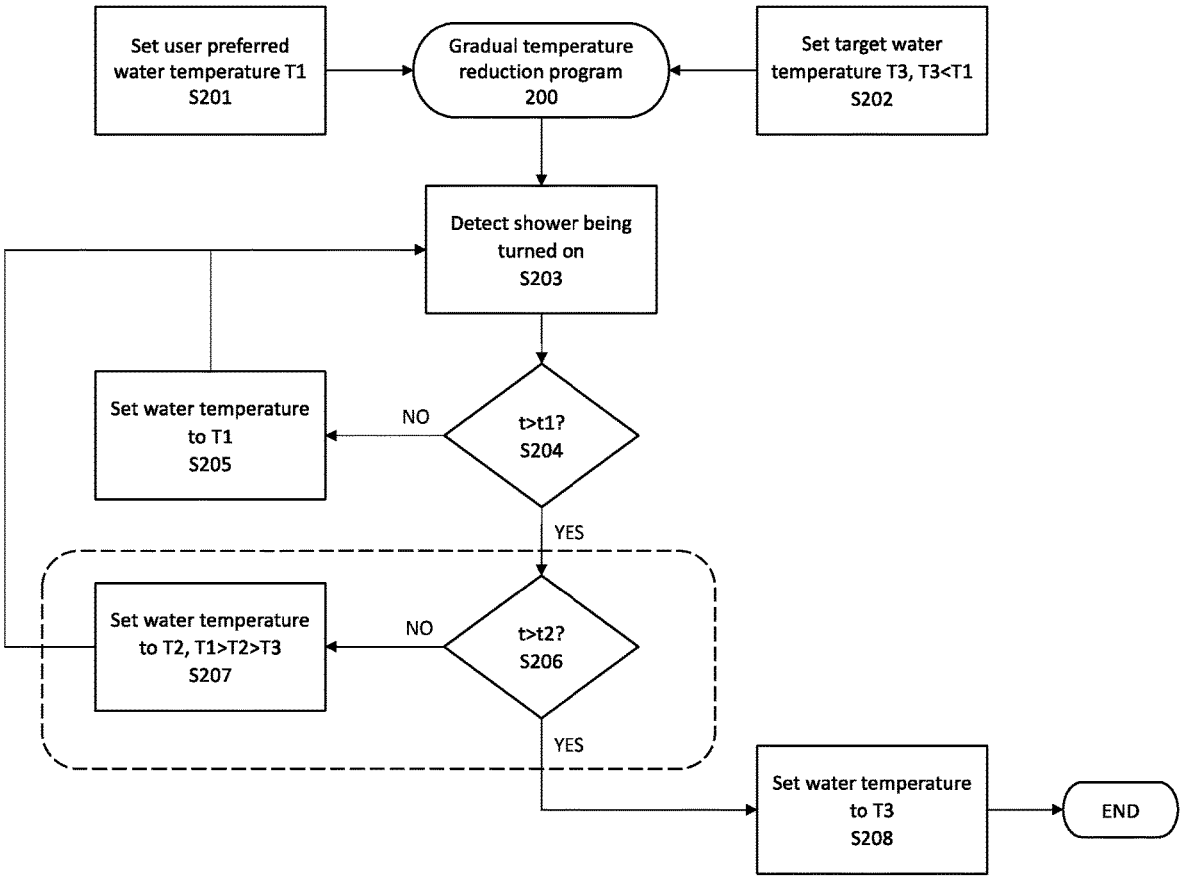
FIG. 2 is a flow diagram of an exemplary method of modulating energy consumed by the water provision system of FIG. 1 according to a first embodiment.

FIG. 2 shows a computer-implemented method of modulating shower water temperature according to a first embodiment.

In the first embodiment, heated water is supplied to a shower by the water provision system 100 described above. The control module 110 is configured to implement a gradual temperature reduction program 200 to gradually reduce shower water temperature over a period of time to a target temperature. The control module 110 is provided with a timer (not shown). At a setup stage, a user preferred water temperature T1 is input at S201 to the program 200, and a target water temperature T3 is input at S202 to the program 200. The user preferred water temperature T1 represents the temperature at which the user normally sets the shower water before the program 200 is implemented, and may for example be 45° C. The target water temperature T3 represents the shower water temperature that the user wishes to adapt to, e.g. 38° C., or an optimal water temperature predetermined by factory setting, e.g. 41° C., based for example on an energy consumption target and/or on health benefit considerations.

When the program 200 is first implemented, the control module 110 initiates the timer to record an elapse time from when the program 200 is first implemented (initial time). Then, upon detecting that the shower is turned on at S203, the control module 110 determines at S204 if the elapse time t recorded by the timer since the program 200 is implemented has exceeded a predetermined first time threshold t1 for reducing water temperature. The first time threshold t1 may be predetermined by factory setting or may be set by the user, and may for example be one day, multiple days, one week, etc.

If it is determined that the elapse time t is less than the first time threshold t1 at S204, the control module 110 sets the shower water temperature to a first temperature T1, the user preferred water temperature, at S205. The method then returns to S203 at the end of the shower until the next time the control module 110 detects the shower is turned on again.

If it is determined at S204 that the elapse time t exceeds the first time threshold t1, the control module 110 then determines at S206 if the elapse time t has exceeded a predetermined second time threshold t2. The second time threshold t2 may again be predetermined by factory setting or may be set by the user, and may for example be multiple of the first time threshold t1 (e.g. t1 may be one week then t2 may be two weeks), or the second time threshold t2 may be set independently of the first time threshold t1 (e.g. t1 may be one week and t2 may be twenty days).

If it is determined at S206 that the elapse time t is less than the second time threshold t2 (but exceed the first time threshold t1), the control module 110 sets the shower water temperature to a second temperature T2 at S207. The second temperature T2 is a temperature lower than the first temperature T1 but higher than the optimal temperature T3, and may be set by the user or calculated based on the user preferred temperature T1 and the target temperature T3, for example T2 may be a temperature halfway between T1 and T3 (e.g. if T1 is 45° C. and T3 is 41° C., T2 may be 43° C.). The method then returns to S203 at the end of the shower until the next time the control module 110 detects the shower is turned on again.

If it is determined at S206 that the elapse time t exceeds the second time threshold t2, the control module 110 sets the shower water temperature to a third temperature T3, the target water temperature, at S208.

For the purpose of illustration, FIG. 2 shows one intermediate water temperature T2 for simplicity. It will however be apparent to one skilled in the art that more than one intermediate stages with multiple intermediate water temperatures at corresponding intermediate time thresholds are possible and may sometimes be desirable, for example when there is a big difference between the user preferred temperature T1 and the final optimal temperature T3. In the above example in which T1 is 45° C. and T3 is 41° C., the control module 110 implementing the program 200 may set the shower water temperature to 44° C. after one week, then 43° C. after two weeks, 42° C. after three weeks, and finally 41° C. after four weeks. Alternative, the intermediate step can be omitted altogether.

According to the present embodiment, it is possible to gradually reduce the energy consumed by heating water for showers as well as potentially improving skin health for the user. The present embodiment is of particular relevance when shower water is heated by the thermal energy storage 150, which stores heat transferred from the surrounding by the heat pump 140, in that by reducing the energy requirement for showers, energy stored in the thermal energy storage 150 may be diverted for other uses such as supplying heated water to kitchen and bathroom taps. In doing so, the water provision system 100 may rely less on the less energy efficient electrical heating elements 160, making the water provision system 100 more energy efficient overall.

Alternating Temperature Modulation

Figure 3:
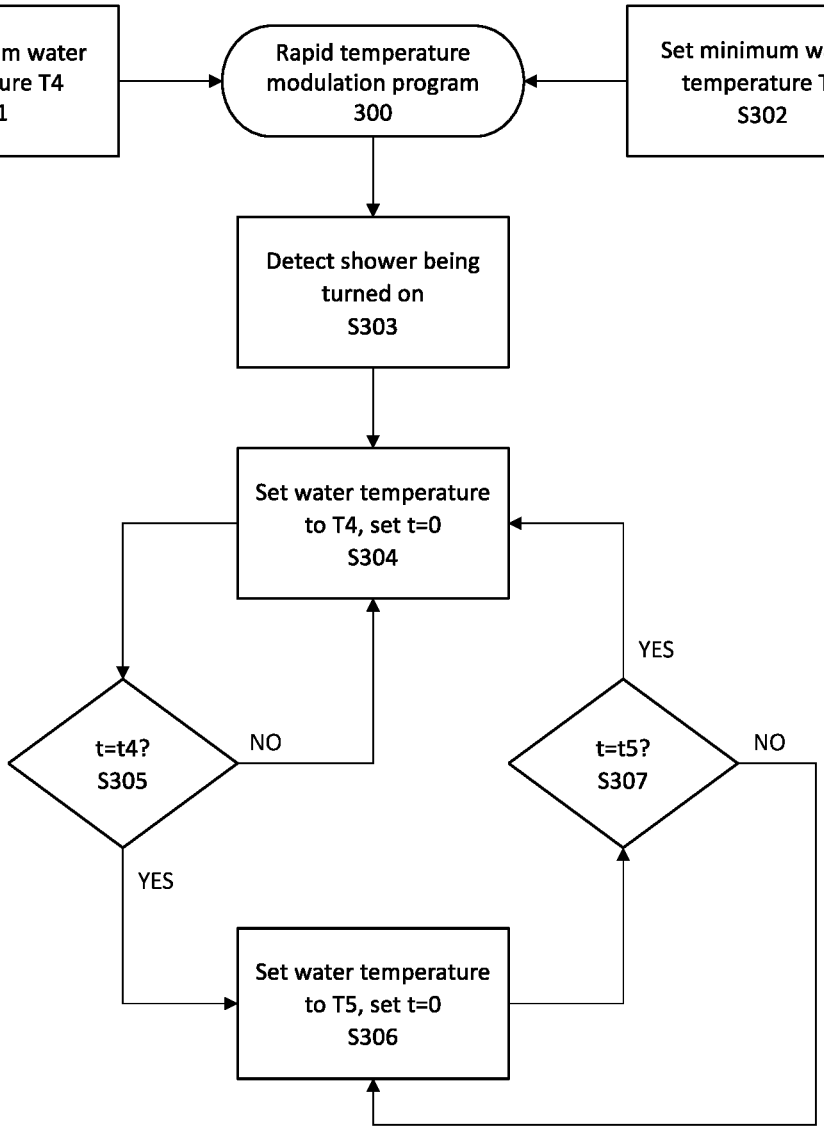
FIG. 3 is a flow diagram of an exemplary method of modulating energy consumed by the water provision system of FIG. 1 according to a second embodiment.

FIG. 3 shows a method of modulating shower water temperature according to a second embodiment.

Similar to the first embodiment, in the second embodiment, heated water is supplied to a shower by the water provision system 100 described above. The control module 110 is configured to implement a temperature modulation program 300 to modulate shower water temperature by alternating between a higher water temperature and a lower water temperature during a shower (this is most likely switching back and forth multiple times but could possibly be one change during a single shower). The control module 110 is provided with a timer (not shown). At a setup stage, a maximum water temperature T4 is input at S301 to the program 300, and a minimum water temperature T5 is input at S302 to the program 300. The maximum water temperature T4 and the minimum water temperature T5 are the water temperatures between which the control module 110 will alternate during a shower, e.g. 41° C. and 38° C. respectively, and they may be set by the user manually or predetermined by factory setting e.g. based on energy consumption considerations and/or health benefit considerations. For example, this is variable, but it could be 1 minute high, 1 minute low over 6 minutes. This is variable and could be profiled to specific users, or optimized through MLAs and tariff costs. In some embodiment, the temperature T4 may be manually set at a temperature preferred by the user and the temperature T5 may be set at a temperature lower than T4 by a predetermined number of degrees manually set by the user or automatically set by the control module 110 to achieve a predetermined energy consumption (saving) target; alternatively, the user may set the lower temperature T5 and the control module may determine the higher temperature T4 according to the predetermined energy consumption target. In further embodiments, the control module 110 may be configure to set both temperatures T4 and T5 to achieve the predetermined energy consumption target guided by user preference e.g. determined using an MLA. The predetermined energy consumption target may be set specifically for shower use, it may be different for different user e.g. based on a user profile, it may be different for different time of the day and/or different season, or it may be set automatically by the control module 110 based on energy tariff, in general or at the time of shower use, to keep energy consumption to below a specified spending target or to reduce the cost of energy consumption by a specified amount. Setting at least one or both of the maximum and minimum water temperature T4 and T5 based on an energy consumption target thus enable the water provision system 100 achieve a desired level of energy consumption saving by avoiding manual input from a human operator who may set arbitrary temperatures that do not the desired energy consumption target.

When the program 300 is implemented, upon detecting that the shower is turned on at S303, the control module 110 sets the water temperature of the shower to the maximum water temperature T4 at S304 and sets the time t on the timer to 0.

The control module 110 then continually monitors the timer and determines, at S305, whether the time t has reached a fourth time threshold t4. If the time t has not reached the fourth time threshold t4, the control module 110 maintains the shower water temperature at T4 and continues to monitor the timer.

If at S305 the control module 110 determines that the time t has reached the fourth time threshold t4, the control module 110 then controls the water provision system 100 to change the shower water temperature from the maximum water temperature T4 to the minimum water temperature T5 at S306, e.g. by reducing the proportion of heated water in the water supplied to the shower. At the same time, the control module 110 resets the time t on the timer to 0.

The control module 110 again continually monitors the timer and determines, at S307, whether the time t has reached a fifth time threshold t5. If the time t has not reached the fifth time threshold t5, the control module 110 maintains the shower water temperature at T5 and continues to monitor the timer.

If at S307 the control module 110 determines that the time t has reached the fifth time threshold t5, the control module 110 then controls the water provision system 100 to return the shower water temperature from the minimum water temperature T5 to the maximum water temperature T4 again at S304, e.g. by returning the proportion of heated water in the water supplied to the shower to the initial level. Again, the control module 110 resets the time t on the timer to 0 and continually monitors the timer.

In the present embodiment, the control module 110 modulates shower water temperature by periodically alternating the shower water temperature between the maximum water temperature T4 and the minimum water temperature T5 during a single shower. The frequency at which the water temperature change occurs (i.e. t4 and t5) may be manually set by the user or predetermined by factory setting. For example, t4 and t5 may be the same, e.g. one minute, or t4 and t5 may be different, e.g. t4 equals five minutes and t5 equals one minute such that the shower is at the warmer setting for five minutes then change to the cooler setting for one minute. Also, a further method of modulation could be 1 minute T4, 1 minute T5, 1 minute T4, one minute T5. Producing a sinusoidal type temperature curve, where the average temperature would then be lower than T4. There are a variety of combinations that could be explored and implemented by users. These are just examples, this is variable, and could be profiled to specific users, or optimized through MLAs and tariff costs.

In an alternative embodiment, upon detecting that the shower is turned on, the control module 110 may first set the shower water temperature to the minimum water temperature T5 when the shower is initially turned on. After the fourth time threshold t4, the control module 110 may alternate the shower water temperature to the maximum water temperature T4, then after the fifth time threshold t5 alternate the shower water temperature back to the minimum water temperature T5 and thereafter alternating back and forth between water temperatures T4 and T5 until the shower is turned off.

In another alternative embodiment, upon detecting that the shower is turned on, the control module 110 may first set the shower water temperature to the maximum water temperature T4 (or the minimum water temperature T5), then after a period of time alternate the shower water temperature to the minimum water temperature T5 (or the maximum water temperature T4) and maintain the shower water temperature at T5 (or T4) until the shower is turned off.

According to the present embodiment, it is possible to reduce the energy consumed by heating water for showers by modulating shower water temperature between a warmer temperature and a cooler temperature compared to when the shower water temperature is maintained at the warmer temperature for the whole duration. The present embodiment is of particular relevance when shower water is heated by the thermal energy storage 150, in that, similar to the first embodiment, by reducing the energy requirement for showers, energy stored in the thermal energy storage 150 may be diverted for other uses such as supplying heated water to other water outlets. In doing so, the water provision system 100 may rely less on the less energy efficient electrical heating elements 160, making the water provision system 100 more energy efficient overall.

It will be apparent to one skilled in the art that the embodiments disclosed herein may be implemented independently or in combination. Embodiments disclosed herein may be implemented using one or more machine learning algorithms such as the MLA 120 of the control module 110.

For example, during a learning phase, the MLA 120 may establish the preferred shower water temperature of a user, and moreover may establish a variation in shower water temperature that is acceptable to the user, e.g. based on any variation in shower water temperature set by the user over a period of time. Thus, for example, the MLA 120 may then be deployed to set a progressively lower shower water temperature for the user over a period of time based on the starting water temperature, an optimal water temperature, and the established acceptable variation. Moreover, the MLA 120 may for example set a maximum shower water temperature and a minimum shower water temperature based on the user's preferred water temperature, and alternate during a single shower based on the acceptable variation. Moreover, embodiments disclosed herein may be implemented in such a way that the programs 200 and/or 300 are implemented differently for each of a plurality of users. For example, the control module 110 may be configured to enable multiple user profiles such that each user may set different preferences for the temperatures T1, T2, T3, T4 and/or T5, and different time thresholds t1, t2, t4 and/or t5.

As will be appreciated by one skilled in the art, the present techniques may be embodied as a system, method or computer program product. Accordingly, the present techniques may take the form of an entirely hardware embodiment, an entirely software embodiment, or an embodiment combining software and hardware.

Furthermore, the present techniques may take the form of a computer program product embodied in a computer readable medium having computer readable program code embodied thereon. The computer readable medium may be a computer readable signal medium or a computer readable storage medium. A computer readable medium may be, for example, but is not limited to, an electronic, magnetic, optical, electromagnetic, infrared, or semiconductor system, apparatus, or device, or any suitable combination of the foregoing.

Computer program code for carrying out operations of the present techniques may be written in any combination of one or more programming languages, including object-oriented programming languages and conventional procedural programming languages.

For example, program code for carrying out operations of the present techniques may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high-speed integrated circuit Hardware Description Language).

The program code may execute entirely on the user's computer, partly on the user's computer and partly on a remote computer or entirely on the remote computer or server. In the latter scenario, the remote computer may be connected to the user's computer through any type of network. Code components may be embodied as procedures, methods or the like, and may comprise sub-components which may take the form of instructions or sequences of instructions at any of the levels of abstraction, from the direct machine instructions of a native instruction set to high-level compiled or interpreted language constructs.

It will also be clear to one of skill in the art that all or part of a logical method according to the preferred embodiments of the present techniques may suitably be embodied in a logic apparatus comprising logic elements to perform the steps of the method, and that such logic elements may comprise components such as logic gates in, for example a programmable logic array or application-specific integrated circuit. Such a logic arrangement may further be embodied in enabling elements for temporarily or permanently establishing logic structures in such an array or circuit using, for example, a virtual hardware descriptor language, which may be stored and transmitted using fixed or transmittable carrier media.

The examples and conditional language recited herein are intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its scope as defined by the appended claims.

Furthermore, as an aid to understanding, the above description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to limit the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudocode, and the like represent various processes which may be substantially represented in computer-readable media and so executed by a computer or processor, whether or not such computer or processor is explicitly shown.

The functions of the various elements shown in the figures, including any functional block labeled as a "processor", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

It will be clear to one skilled in the art that many improvements and modifications can be made to the foregoing exemplary embodiments without departing from the scope of the present techniques.

The invention claimed is:

1. A computer-implemented method of modulating energy consumption by a water provision system installed in a building, the water provision system comprising:

a hot water outlet;

a thermal energy storage inside the building, the thermal energy storage containing a thermal energy storage medium;

a heat pump configured to transfer thermal energy from outside the building to the thermal energy storage medium;

a heat exchanger arranged proximal to the thermal energy storage configured to heat water for provision by the water provision system to the hot water outlet using thermal energy stored in the thermal energy storage medium;

a plurality of sensors including temperature sensors, pressure sensors and timers; and a control module including a processor configured to receive executable instructions from a non-transitory computer readable storage medium which, when executed by the processor, cause the control module to control operation of the water provision system, the method being performed by the control module and comprising:

receiving input from the plurality of sensors;

setting a first temperature for heated water being provided to the hot water outlet;

setting a second temperature for heated water being provided to the hot water outlet, the second temperature being different from the first temperature;

determining that the hot water outlet is turned on; and in response to determining that the hot water outlet is turned on, alternating a temperature of heated water provided to the hot water outlet between the first temperature and the second temperature, wherein the control module executes a machine learning algorithm (MLA) which is trained using data from the plurality of sensors to establish a learned water and energy usage pattern, wherein the control module sets the first temperature and/or the second temperature to achieve a predetermined energy consumption target guided by the learned water and energy pattern usage determined by the MLA.

2. The method of claim 1, wherein the control module comprises a timer, the method further comprising, upon alternating the temperature of heated water provided to the hot water outlet to the first temperature, initializing the timer to zero to record a first elapse time.

3. The method of claim 2, further comprising, upon determining that the first elapse time exceeds a first time threshold, alternating the temperature of heated water provided to the hot water outlet to the second temperature.

4. The method of claim 1, wherein the control module comprises a timer, the method further comprising, upon alternating the temperature of heated water provided to the hot water outlet to the second temperature, initializing the timer to zero to record a second elapse time.

5. The method of claim 4, further comprising, upon determining that the second elapse time exceeds a second time threshold, alternating the temperature of heated water provided to the hot water outlet to the first temperature.

6. The method of claim 3, wherein the first time threshold is set by a user.

7. The method of claim 3, wherein the first time threshold is a multiple of a minute.

8. The method of claim 5, wherein the first temperature is higher than the second temperature, and the first time threshold is higher than the second time threshold.

9. The method of claim 1, further comprising receiving an input of the first temperature from a user.

10. The method of claim 1, further comprising receiving an input of the second temperature from a user.

11. The method of claim 1, wherein the temperature of heated water provided to the hot water outlet is alternated only once from the first temperature to the second temperature during a single use of the hot water outlet.

12. The method of claim 1, wherein the temperature of heated water provided to the hot water outlet is alternated a plurality of times between the first temperature and the second temperature during a single use of the hot water outlet.

13. The method of claim 1, wherein the first temperature and the second temperature are in a range of 35° C. to 44° C.

14. The method of claim 1, further comprising storing a plurality of user profiles, each profile corresponding to one of a plurality of users of the hot water outlet and comprises a corresponding first temperature.

15. The method of claim 14, wherein each profile comprises a corresponding second temperature.

16. A control module for controlling operation of a water provision system installed in a building, the water provision system comprising:

a hot water outlet;

a thermal energy storage inside the building, the thermal energy storage containing a thermal energy storage medium;

a heat pump configured to transfer thermal energy from outside the building to the thermal energy storage medium;

a heat exchanger arranged proximal to the thermal energy storage configured to heat water for provision by the water provision system to the hot water outlet using thermal energy stored in the thermal energy storage medium;

a plurality of sensors including temperature sensors, pressure sensors and timers; and a control module including a processor configured to receive executable instructions from a non-transitory computer readable storage medium which, when executed by the processor, cause the control module to control operation of the water provision system to implement the method of claim 1.

17. A water provision system for provisioning heated water to a water outlet, comprising:

a hot water outlet;

a thermal energy storage inside the building, the thermal energy storage containing a thermal energy storage medium to store thermal energy;

a heat exchanger arranged proximal to the thermal energy storage configured to heat water for provision by the water provision system to the hot water outlet using thermal energy stored in the thermal energy storage medium;

a heat pump configured to transfer thermal energy from outside the building to the thermal energy storage medium;

a plurality of sensors including temperature sensors, pressure sensors and timers; and a control module including a processor configured to receive executable instructions from a non-transitory computer readable storage medium which, when executed by the processor, cause the control module to control operation of the water provision system, the control module being configured to:

receive input from the plurality of sensors;

set a first temperature for heated water being provided to the hot water outlet;

set a second temperature for heated water being provided to the hot water outlet, the second temperature being different from the first temperature;

determine that the hot water outlet is turned on; and in response to determining that the hot water outlet is turned on, alternate a temperature of heated water provided to the hot water outlet between the first temperature and the second temperature, wherein the control module executes a machine learning algorithm (MLA) which is trained using data from the plurality of sensors to establish a learned water and energy usage pattern, wherein the control module sets the first temperature and/or the second temperature to achieve a predetermined energy consumption target guided by the learned water and energy usage pattern determined by the MLA.

18. The system of claim 17, wherein the water provision system further comprises one or more electrical heating elements configured to heat water for provision by the water provision system.

19. The water provision system of claim 17, wherein the hot water outlet is a shower.

20. A computer program stored on a non-transitory computer readable storage medium for, when executed on a computer system, instructing the computer system to carry out a method as in claim 1.

* * * * *